US005642426A

United States Patent [19]

Neuman et al.

[11] Patent Number: 5,642,426

[45] Date of Patent: *Jun. 24, 1997

[54] INTEGRAL RADIO AND INFRARED ASSISTIVE LISTENING DEVICE

[76] Inventors: Bernard Neuman; Sandra J. Neuman, both of 7972-A Lexington Club, Delray Beach, Fla. 33446

[ * ] Notice: The term of this patent shall not extend beyond the expiration date of Pat. No. 5,506,911.

[21] Appl. No.: 401,729

[22] Filed: Mar. 10, 1995

Related U.S. Application Data

[63] Continuation-in-part of Ser. No. 259,691, Jun. 13, 1994, Pat. No. 5,506,911.

[51] Int. Cl.[6] ..... H04R 25/00

[52] U.S. Cl. ..... 381/68; 381/183; 381/187; 381/111

[58] Field of Search ..... 381/183, 187, 381/188, 205, 68, 111; 439/430

[56] References Cited

U.S. PATENT DOCUMENTS 4,633,498 12/1986 Warnke et al. ..... 381/23.1
5,383,043 1/1995 Su ..... 359/142

*Primary Examiner*—Sinh Tran
*Attorney, Agent, or Firm*—Alvin S. Blum

[57] ABSTRACT

An assistive listening device has a housing enclosing both infrared radiation and FM radio receivers and audio amplifier for receiving audio information transmitted to the hearing impaired audience in an auditorium by either infrared or radio radiation. The received radiation is converted to an amplified electrical audio signal. The signal is converted to audible sound by two earphones at the distal ends of two extendable arms. The arms are attached at their proximal ends to the housing. The arms may have two configurations, a compact configuration in which the earphones are retracted to a position against the housing for storage or transport and an extended configuration in which the earphones are at a distance from the housing and spaced apart less than the distance between a user's ears. When the earphones are in the ears, the device is held in place by spring bias with the housing hanging below the chin. For folding into compact configuration the arms may be elastic to bend around the edge of the housing. Alternatively, the arms may be jointed to fold around the housing. When the arm is adjacent the edge of the housing, the entire device is not only more compact for transport and storage, but the fragile arms and earphones are protected from damage.

7 Claims, 5 Drawing Sheets

IR
FM
V

INTEGRAL RADIO AND INFRARED ASSISTIVE LISTENING DEVICE

This is a continuation in part of patent application Ser. No. 08/259,691 filed Jun. 13, 1994, now U.S. Pat. No. 5,506,911.

TECHNICAL FIELD

This invention relates to assistive listening devices and more particularly to those devices receiving infrared and radio transmission, worn by hearing impaired people while attending concerts, plays and other entertainment or educational affairs in an enclosed environment such as a theater, auditorium or other assembly room where acoustical aid is needed.

DESCRIPTION OF THE PRIOR ART

Public theaters transmit wireless signals of the sound from a performance for hearing impaired audience members on either FM radio (FM) or infrared (IR) radiation carriers. Management provides assistive listening devices (ALD's) to the public for use during a performance. The ALD receives either the FM or the IR, decodes, amplifies and converts the transmitted signal into audible sound at earphones at the distal ends of two arms extending from a housing encasing the electronics and battery.

The devices are fragile and easily damaged. Many users consider them unsanitary, since the earphones fit into or onto the ears of strangers and may transmit contaminants from the hair or ears of others.

Many users would prefer to use their own ALD, especially if it were compatible with both FM and IR. If the device were less fragile and bulky and the earphones were not exposed to soiling or damage, the ALD would be more acceptable and easier to carry to performances. If the battery did not require frequent replacement, it would be easier for incapacitated users to maintain.

Since the earphones will be in the ears while the housing is below the chin, the minimum length of the extension arms from earphones to housing is predetermined by normal human anatomy when in the operational mode.

A novelty search of the patented art relating to hearing devices, and particularly those that are capable of moving between an expanded operational configuration and a contracted configuration for storage when not in use, discovered the following U.S. Pat. Nos.: 4,409,442 issued Oct. 11, 1983, to Kamimura; 4,445,005 issued Apr. 24, 1984 to Furuhashi; 4,463,223 issued Jul. 31, 1984 to Yamanoi et al.; 4,465,907 issued Aug. 14, 1984 to Minear et al.; 4,517,418 issued May 14, 1985 to Baran et al.; 4,571,746 issued Feb. 25, 1986 to Gorike; 4,597,469 issued Jul. 1, 1986 to Nagashima; 4,609,786 issued Sep. 2, 1986 to Omoto et al.; 5,027,433 issued Jun. 25, 1991 to Menadier et al.; 5,095,382 issued Mar. 10, 1992 to Abe; 5,099,519 issued Mar. 24, 1992 to Guan; 5,253,095 issued Oct. 12, 1993 to Menadier et al.; 4,920,570 issued Apr. 24, 1990 to West.

None of the patents found in the novelty search discloses an integral hearing device for both IR and FM comprising a base housing supported below the chin by earphones. None have dimensions sufficiently small to fit inside a case on the order of magnitude of an eyeglass case. The structural elements of the prior art devices are not capable of folding inward from an unfolded configuration when in use to a closed configuration in which the portions of the extension arms embrace the base housing in such a closely hugging relation that the device when closed is capable of fitting within a storage case whose size approximates that of an eyeglass case.

West discloses a receiver for both IR and FM, but this is in a hand-held unit which transmits by a single wireless carrier to a separate headphone. The hand held receiver is poorly positioned for reception in a theater, is awkward to hold, and is easily dropped.

SUMMARY OF THE INVENTION

It is accordingly an object of the invention to provide different structural features from those of the prior art devices, including combining FM and IR receivers.

Because of the novel construction of the assistive listening devices of this invention, it is possible for a theater to store many cases containing the devices in a storage space considerably smaller than was required for the large devices of the prior art. Also, for those users who prefer to carry their personal listening devices with them, it is much more convenient for them to carry their device in a carrier case of a size comparable to an eyeglass than the bulkier devices of the prior art. In order to make it possible to attain this goal of storing the device within such a small storage case when not in use, it is necessary to construct and arrange the elements of the hearing device in such a manner that the elastic arms and earphones carried by the distal ends thereof enclose the base housing containing the electronic elements of the hearing device as well as a power source contained within the base housing so closely as to essentially hug or embrace the base housing. The base housing has broad opposed front and rear walls joined together by narrow edges. The arms, when in compact mode, are closely applied to the narrow edges in an embracing or encircling configuration.

This embracing feature not found in the prior art devices makes it more convenient for a user who owns a hearing device to carry it from home to an auditorium, and/or makes it more convenient for a theater or auditorium to store a plurality of such hearing devices in a relatively small area of the theater or auditorium when local statutes require theater or auditorium owners to have hearing devices available for members of the audience who require help to overcome hearing problems. In one embodiment of this invention, the elongated extension arms that carry the earphones at their distal ends have distal pivots that divide the elongated arms into proximal arm portions having a length approximating the length of the base housing and distal arm portions having a length approximating those of the left and right side edges of the base housing. In addition, portions of the base housing may be recessed to receive the earpieces fixed to the distal ends of the elongated arms to protect the earpieces from damage and contamination when not in operation.

The present invention may also include automatic switch means to disconnect the power source from the device automatically whenever the device is folded to a closed configuration for storage and limits the use of the power source only to those times when the device is unfolded to its open configuration for operation. This additional feature assures that the power source does not lost its strength and operability prematurely, and battery changing is not often required by a user who may be incapacitated.

In its broadest scope, each jointed extension arm of this embodiment of the invention comprises a proximal arm portion and at least one distal arm portion pivoted to said proximal arm portion at at least one distal pivot spaced from a proximal pivot of said jointed extension arm where the latter extends from the base housing. The distal pivot, or pivots, and proximal pivot of a given arm are arranged to rotate in a common first direction for extension and in a common opposite direction for folding into a compact configuration.

Alternatively, the arms may be unjointed. They may not fold for storage, or they may be sufficiently elastic that they bend around the housing for compact storage.

BRIEF DESCRIPTION OF THE DRAWINGS

FIG. 6 is a schematic diagram of another embodiment of the invention capable of both IR and FM reception.

DESCRIPTION OF THE PREFERRED EMBODIMENTS

Figure 1:
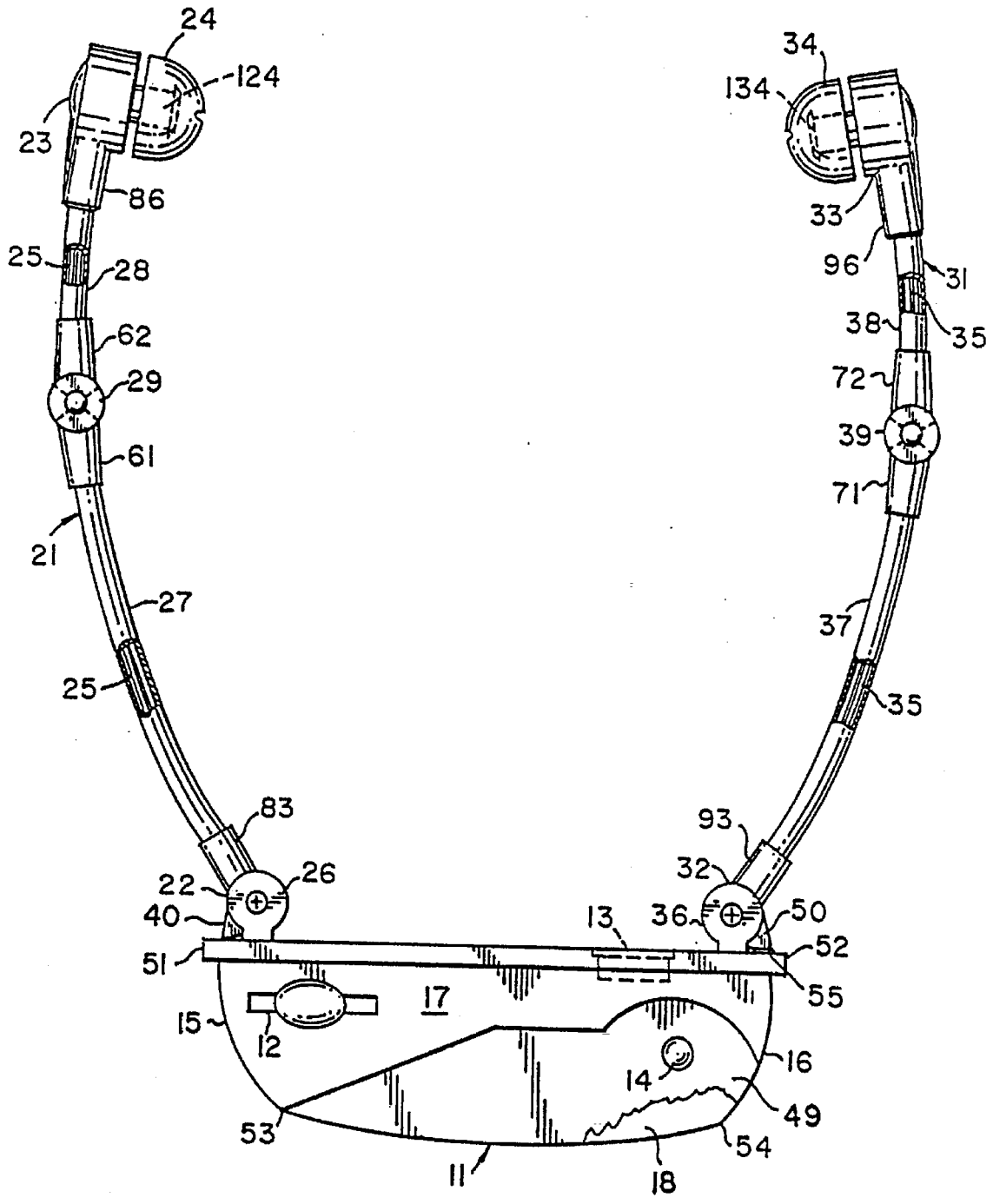
FIG. 1 is an elevational view with parts exposed of a hearing device of this invention in its open unfolded configuration ready for use.
Figure 2:
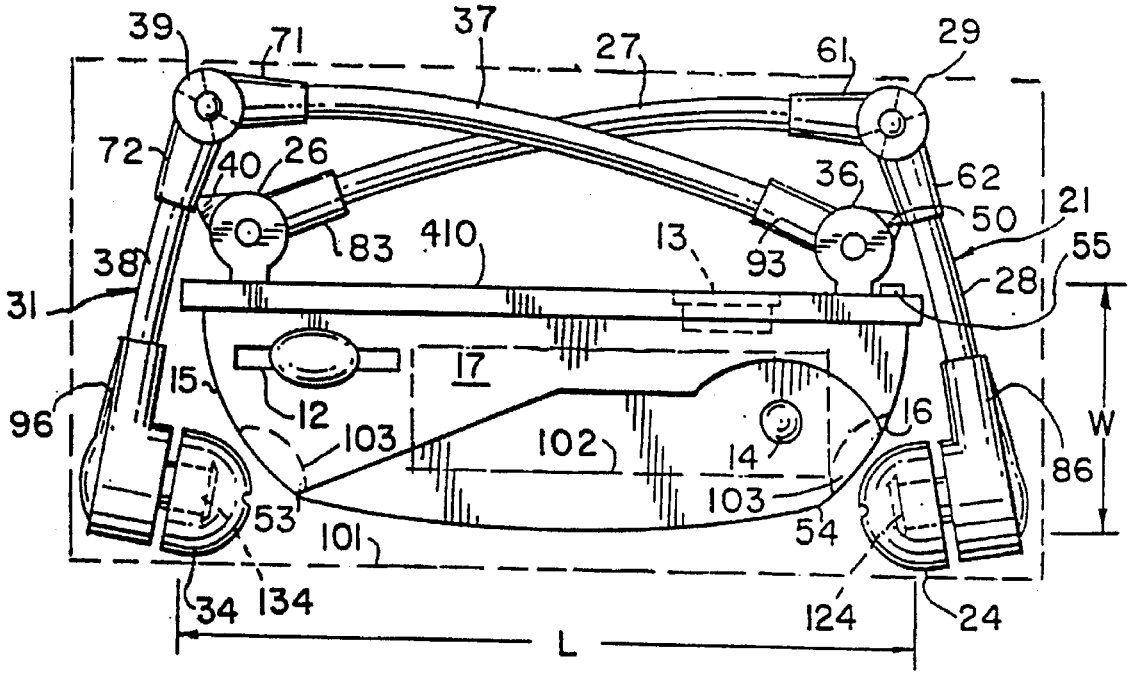
FIG. 2 is a view similar to FIG. 1, showing the FIG. 1 device folded to its closed configuration wherein the elongated arm portions that support the earphones at their distal ends are folded into a closed position wherein the device is capable of storage within a small storage case of a size approximating that required for storing a set of eyeglasses.

Referring now to FIGS. 1 and 2, a hearing device conforming to a preferred embodiment of this invention comprises a base housing (11) constructed and arranged to support electronic decoder means (102) shown in phantom, a volume control (12), a removable and replaceable power source (13) such as a battery pack or the like, and an infrared or FM radio receiver (14), of the type well known in the art, therewithin. Base housing (11) has top edge (410), a left side edge (15), a right side edge (16), a front wall (17) and a rear wall (18). Front wall (17) is apertured in front of a position occupied by infrared or FM radio receiver (14) so as to enable the latter to be exposed to a source of radiant energy (not shown). Housing (11) has an upper left corner portion (51), an upper right corner portion (52), a lower left corner portion (53) and a lower right corner portion (54).

The terms "left" and "right" refer to the orientation of the various elements of the illustrative device as seen by a person looking at the front side of a user. Consequently, when the device is worn by a user, each element of the device shown on the left side of the device in the drawing is carried to the right side of the user, and each element shown on the right side of the device in the drawing is carried to the left side of the user.

A left, jointed earphone extension arm (21) having a proximal end (22) and a distal end (23) is longitudinally apertured along its length to receive a pair of electroconductive wires (25), and is pivoted to the upper left corner portion (51) of base housing (11) at a proximal pivot (26). Extension arm (21) has a proximal portion (27) and a distal portion (28) pivoted to portion (27) at a distal pivot (29). In addition, an earphone (24) is fixed to distal end (23) of arm (21) to extend inward from distal end (23) into the right ear of a user.

The device is also provided with a right, jointed earphone extension arm (31) having a proximal end (32) corresponding to proximal end (22) of left extension arm (21), a distal end (33) corresponding to distal end (23), and is longitudinally apertured along its length to receive electroconductive wires (35) corresponding to wires (25). Right, jointed extension arm (31) is pivoted to upper right corner portion (52) of base housing (11) at a proximal pivot (36) corresponding to proximal pivot (26). Extension arm (31) has a proximal portion (37) pivoted to a distal portion (38) at a distal pivot (39). In addition, an earphone (34) extends inward toward earphone (24), so that both ears of a user are simultaneously engaged by earphones (24) and (34) when extension arms (21) and (31) are unfolded away from one another. Earphones (24) and (34) include earphone tips (124) and (134), shown in phantom.

Jointed arm (31) is pivoted inwardly into a closed configuration around the edges of base housing (11) for storage in a small storage case whose size is on the order of magnitude of an eyeglass case. When jointed extension arm (31) is folded inward, its proximal portion (37) extends along the length (L) of base housing (11) in close relation thereto from adjacent right upper corner portion (52) to adjacent upper left corner portion (51), distal portion (38) extends along the width (W) of left side wall (15) from adjacent upper left corner portion (51) to adjacent lower left corner position (53), and earphone (34) reaches a position closely adjacent to the left bottom corner portion (53) of base housing (11) as shown in FIG. 2.

Also, in this closed configuration, proximal portion (27) of left jointed extension arm (21) extends along the length of the top edge (40) of base housing (11) from a position adjacent upper left corner portion (51) to a position adjacent upper right corner portion (52), distal portion (28) of left jointed extension arm (21) extends downward along the right side wall or edge (16) from a position adjacent upper right corner portion (52) to a position adjacent lower right corner portion (54), and earphone (24) reaches a position closely adjacent the right bottom corner portion (54) of base housing (11) with portions (27) and (28) of left extension arm (21) closely adjacent to the top edge and right side edge (16) of base housing (11). This folded configuration enables the device to fit into a case (101) shown in phantom, while guarding the earpieces from trauma and contamination when not in use in the ear canals.

In other words, this invention suggests that the jointed extension arms be constructed and arranged so that proximal portions (27) and (37) have lengths approximating the length of base housing (11) and the distal portions (28) and (38) have lengths approximating the length of side edges (15) and (16) of base housing (11). Thus when arms (21) and (31) are folded, they embrace base housing (11) in a substantially hugging relationship that not only insures a compact configuration for the device when not in use, but it also enables the relatively rigid structure of housing (11) to reinforce the relatively fragile structures of arms (21) and (31). If desirable, lower corner portions (53) and (54) may be recessed in outline to receive earphones (34) and (24) in the folded configuration. By positioning each fragile earphone protectively adjacent the rigid housing, the folded configurations shield the earphone against damage and contamination.

A projection (40) is provided in the vicinity of proximal pivot (26). Another projection (50) in the vicinity of proximal pivot (36) symmetrical to projection (40) is engaged by distal portion 28 of extension arm (21) when the latter is folded. Projections (40) and (50) are so constructed and arranged that a selected one of projections (40) or (50) turns an associated switch (55) on when arms (21) and (31) are unfolded outward and earphones (24) and (34) are applied to the ears of a user. When arms (21) and (31) are folded inward, said projection (40) or (50) turns its associated switch (55) off to enable the life power source (13) to be extended. Projection (40) is not associated with a switch, but is included with the parts of the device to simply the inventory of parts to assemble the device. Projections (40) and (50) limit the angle to which the extension arms may be opened so that some elastic tension is applied to the earpieces to maintain their position in the ears with the housing suspended below the chin.

The elongate arms (21) and (31) are tubular and carry electroconductive wires (25), (35) therein to transmit electrical signals to the earpieces. Reinforcing elements (83), (61), (62), (86) of arm (21) and corresponding elements (93), (71), (72), (96) of arm (31) are also tubular for carrying the wires therein.

An electronic board (49) carries infrared and/or FM radio sensing, amplifying and decoding means converting the sensed radiation into audio signals to the earphones. It is supported within base housing (11), and wires (25) are connected at their proximal ends to the board (49).

Figure 5:
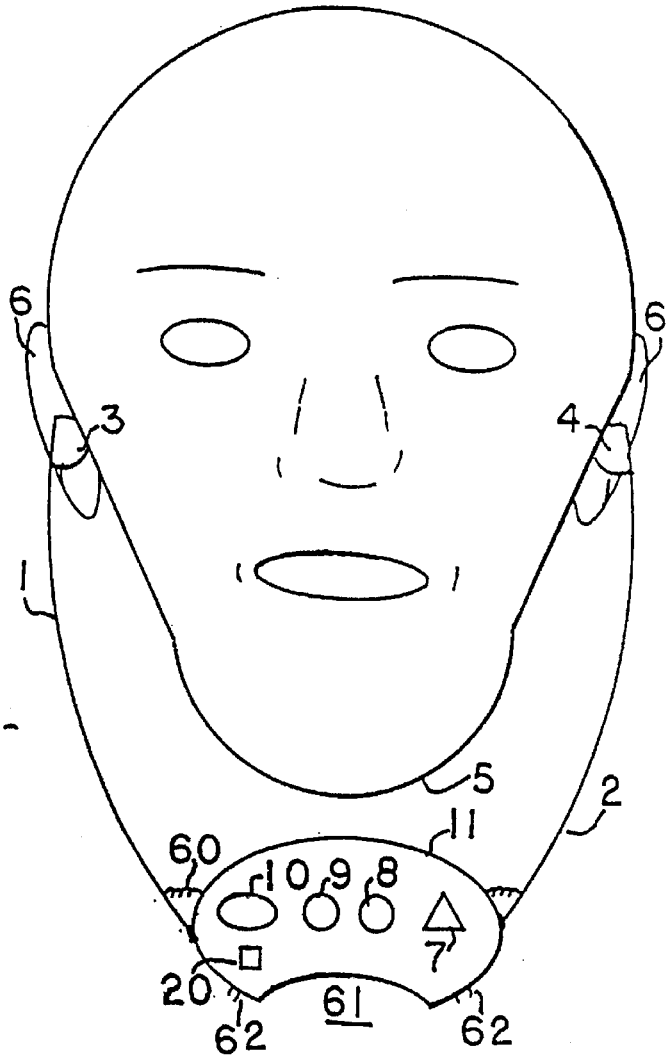
FIG. 5 is an elevational view of the device of FIG. 3 in operation.
Figure 3:
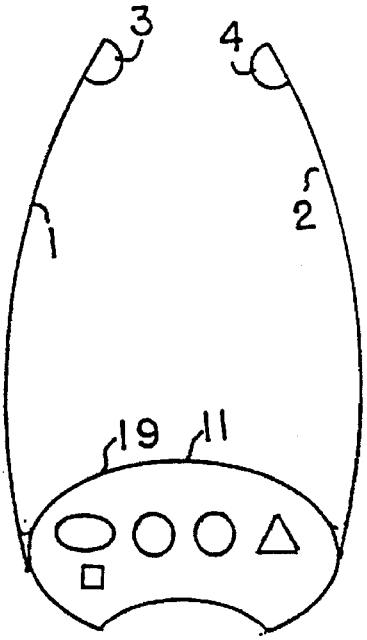
FIG. 3 is an elevational view of another embodiment of the invention with unjointed arms in relaxed position.
Figure 4:
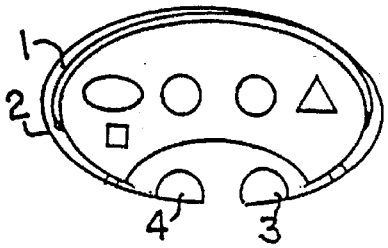
FIG. 4 is an elevational view of the device of FIG. 3 with arms bent to the closed position.
Figure 7:
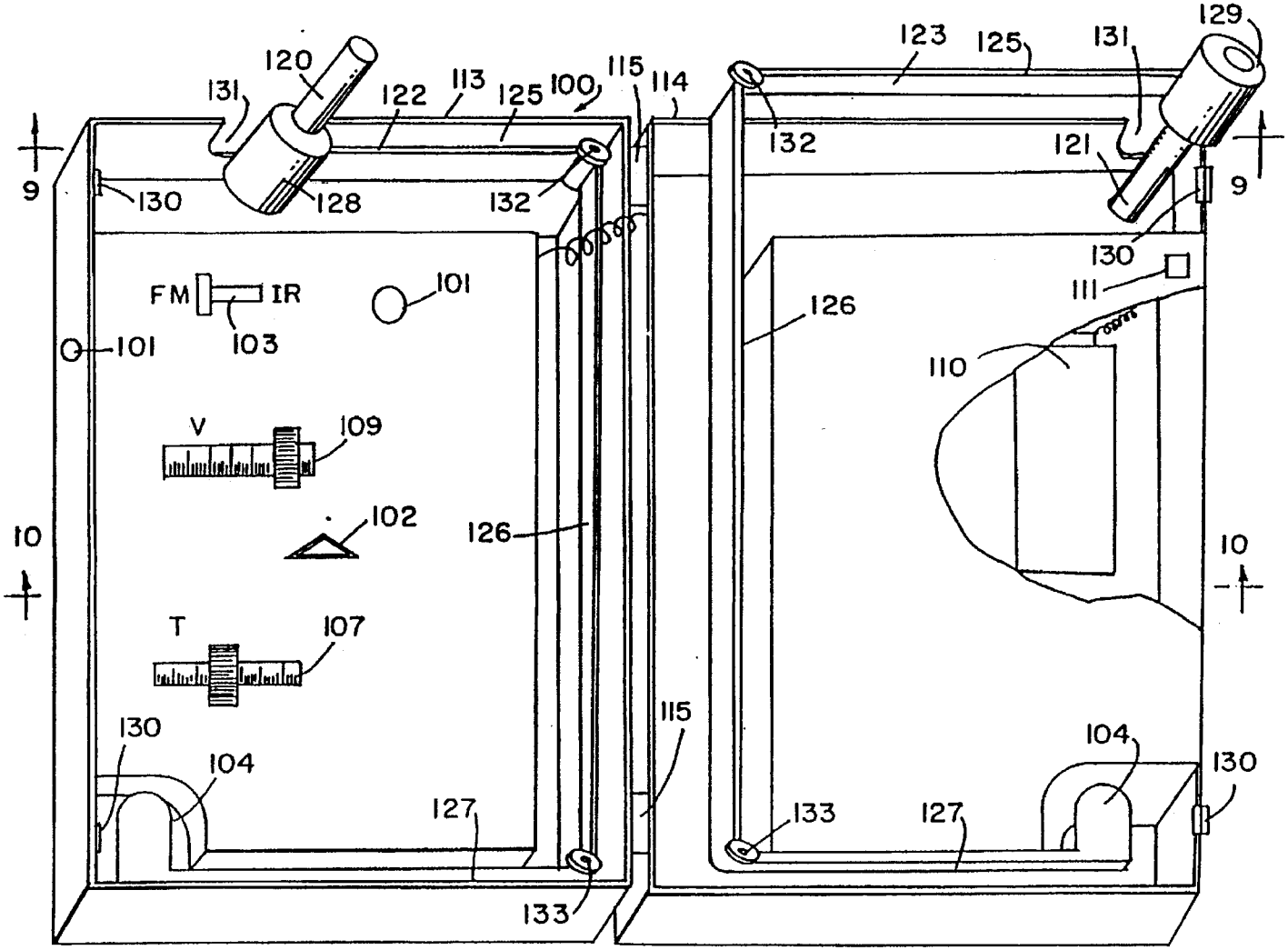
FIG. 7 is a perspective view of another embodiment of the invention with IR and FM and integral carrying case.

Referring now to FIGS. 3–5, an alternative embodiment of the invention is shown in which the arms (1), (2) are not jointed. They may be rigid and urged toward one another by spring bias means (60). Alternatively, they may be made of an elastic material such as spring steel strip which assumes the configuration shown in FIG. 3 when unstressed. When spread apart and inserted in the arms (6) of a user, the spring bias urges the earpieces (3), (4) toward one another, thereby holding the assembly in place with the housing suspended below the chin (5) as shown in FIG. 5.

The elastic arms may optionally have sufficient flexibility that they may be wrapped around the narrow oval edge (19) of the housing into the compact or storage configuration shown in FIG. 4. Recess (61) in the housing protectively receives the earpieces in the compact form. The compact form may be slipped into a case (now shown) or clips (62) may hold the arms against the housing for storage.

The housing (11) encloses all of the necessary electronics components and battery for converting IR or FM radiation into audio signals which are then transmitted to the earpieces by wire along the arms as described for other embodiments. Shown in the housing are the FM receiver (7), the IR receiver (8), the volume control (9), selector switch (10) for selecting either FM or IR reception, and on/off switch (20). Tuning may be performed manually or by automatic tuning circuitry well known in the art.

Referring now to FIGS. 6–10, an ALD (100) is shown that provides for receiving both IR radiation through three IR sensors (101) facing in three different directions and FM radiation through antenna (102). An IR amplifier and decoder (105) receives infrared radiation from sensors (101), and feeds audio signals to IR/FM selector switch (103). An FM amplifier and decoder (106) receives radiation from antenna (102), and feeds audio signals to IR/FM selector switch (103). A tuning control (107) may be provided to select particular FM frequency or bandwidth response. The decoded signals selected by switch (103) from either IR or FM are then fed to audio amplifier (108) which may be provided with volume control (109). The amplified audio signals are fed by wire to the individual earphones (104) where they are transduced into audible signals. Battery (110) provides power through on/off switch (111).

Figures 8, 9, 10, 11:
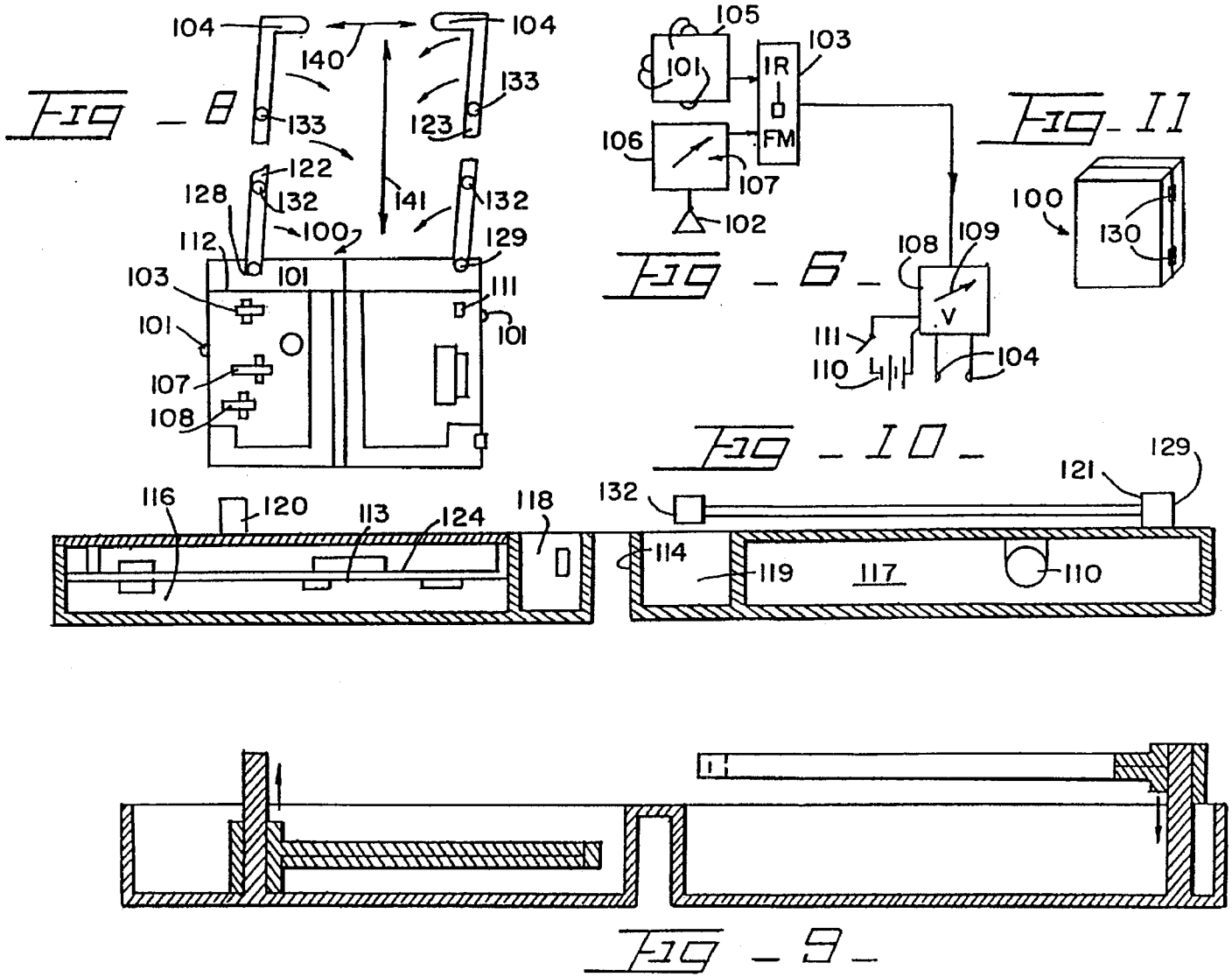
FIG. 8 is a plan view of the device of FIG. 7 open for use.
FIG. 9 is a sectional view taken through line 9—9 of FIG. 7.
FIG. 10 is a sectional view taken through line 10—10 of FIG. 7.
FIG. 11 is a perspective view of the device of FIG. 7 closed.

This embodiment of the invention provides certain structural features which enhance its utility. As best seen in FIG. 11, when closed for transport, the ALD (100) provides its own hard outer shell, protecting the fragile contents from contamination and injury. The outer shell is integral with the housing (112) so that there is no possibility of misplacing the case. The housing (112) comprises two hard plastic compartments (113) and (114) joined by hinges (115). Each compartment comprises a closed chamber (116), (117) surrounded on three sides by a trough (118), (119). Each trough contains a jointed extension arm (122), (123) pivotally connected to the compartment in the trough by pivot pins (120), (121) attached to the bottom of the trough. Contained within chamber (116) is electronic circuit board (124) containing the electronic components. Contained within chamber (117) is battery (110) connected to on/off switch (111) which is depressed when the case is closed, thereby disconnecting the battery. Each extension arm is comprised of three segments, a proximal segment (125), an intermediate segment (126) and a distal segment (127) pivotally joined together, wherein the segments may be aligned along their long axes as shown in operational mode in FIG. 8, with the arm extended orthogonally from the trough. To extend orthogonally from the trough, the proximal end of each extension arm must be pulled up along pin (120) and pin (121) until it is clear of the trough so that it may be rotated. Notches (131) in the case receive the extended arms and maintain the orthogonal position to apply tension to earpieces. To fold the arms and store them for transport, they are folded around the compartments (116), (117) so that they will fit into the troughs, and then the proximal pivot ends (128), (129) are pushed down on pins (120), (121) until the folded arms fit into the troughs. At this time the two halves may be folded together with snap catches (130) holding the case closed. The ALD when closed has dimensions no greater than a conventional spectacle case for ease of storage and transport. The hard plastic outer covering protects the contents from soiling or damage.

The intermediate pivots (132) and distal pivots (133) may be constructed with all of the three pivots of an extension arm rotating in a first common direction for extension and a second common direction for folding into the trough surrounding the compartments.

As best seen in FIG. 8, when the extended or operational configuration, the distance (140) between opposed earphones is less than the distance between a user's ears. The extension arms (122), (123) are elastic, so that when they are spread apart to fit onto the ears, spring bias holds then in place. The pivots have stops to prevent them from excessive rotation beyond the extended position wherein the arm portions are aligned along their long axes.

The earphones (104) are extended at a distance (141) far enough from housing (112) that the housing lies below the user's chin when in operation.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A self-contained assistive listening device for converting audio information transmitted on FM radio or infrared radiation carriers into audible sound at the ears of a user, the device comprising:

A) FM radio receiver means for receiving, amplifying and decoding said FM radio radiation carrier and providing therefrom an electrical audio signal containing said audio information;

B) infrared radiation receiver means for receiving, amplifying and decoding said infrared radiation carrier and providing therefrom an electrical audio signal containing said audio information;

C) audio amplifier means connected to said FM radio and said infrared radiation receiver means for amplifying said electrical audio signal received from either said FM receiver means or said infrared receiver means;

D) volume control means connected to said amplifier means for adjusting the strength of said electrical audio signal from said amplifier means;

E) electric power means for connecting and providing electric power to said device;

F) a housing having broad front and back faces with the peripheries thereof joined together by a narrow perimetral edge to define an enclosure, said enclosure containing said FM radio receiver means, said infrared radiation receiver means, said audio amplifier means, said volume control means, and said electric power means;

G) a pair of elongate arms, each of said arms connected at a proximal end to said housing, said arms having long axes;

H) an earphone connected at the distal end of said each arm and operatively connected to said audio amplifier means for converting said electrical audio signal into audible sound at the ears of the user, I) wherein the distance from said earphones to said housing being great enough so that said housing will rest comfortably and inconspicuously below the user's chin; in which said perimetral edge is substantially rectangular, comprising a top edge portion, a bottom edge portion and two side edge portions, said said each arm pivotally connected at said proximal end to a first edge portion of said perimetral edge by a proximal pivot, said each arm comprising an elongate first arm portion and an elongate second arm portion joined together by a second pivot, with each of said arm portions having a long axis; said each arm arranged to fold up adjacent the perimetral edge of said housing means in a compact storage or folded configuration in which said first arm portion lies substantially parallel to said top edge portion and said second arm portion lies transverse to said first arm portion, substantially parallel to one of said side edge portions with said earphone protectively adjacent said housing means, said each arm arranged to unfold to an operational configuration in which said earphones are positioned away from said housing means, opposed to one another, and spaced apart from one another by a distance less than the distance between the user's ears so that when said earphones are applied to the ears, spring bias generated by forcing said arms apart will hold said earphones in place, said each proximal pivot providing rotary motion of said first arm portion between said folded configuration parallel to and adjacent said top edge portion and said operational configuration lying transverse to said top edge portion and said each second pivot providing rotary motion of said second arm portion between said folded configuration transverse to said first arm portion and adjacent said one side edge portion and said operational configuration in which the long axes of said first and second arm portions are substantially aligned, said proximal pivot and said second pivot rotating in a first common direction for extension and in a second, opposite, common direction for folding, and wherein said each arm further comprising a third arm portion pivotally connected by a third pivot to said second arm portion, said third arm portion arranged to lie transverse to said second arm portion in said folded configuration and substantially aligned with said second arm portion in said operational configuration.

2. The device according to claim 1, further comprising rigid trough means integral with said housing means, said trough means arranged to receive therein said arms in said folded configuration.

3. The device according to claim 1, in which said third pivot is provided with stop means to prevent said third arm portion from rotating beyond said operational configuration so that spreading apart said earphones will generate said spring bias.

4. The device according to claim 3, further comprising trough means integral with said housing means, said trough means arranged to receive therein said arms in said folded configuration.

5. A self-contained assistive listening device for converting audio information transmitted on FM radio or infrared radiation carriers into audible sound at the ears of a user, the device comprising:

A) FM radio receiver means for receiving, amplifying and decoding said FM radio radiation carrier and providing therefrom an electrical audio signal containing said audio information;

B) infrared radiation receiver means for receiving, amplifying and decoding said infrared radiation carrier and providing therefrom an electrical audio signal containing said audio information;

C) audio amplifier means connected to said FM radio and said infrared radiation receiver means for amplifying said electrical audio signal received from either said FM or infrared receiver means;

D) volume control means connected to said amplifier means for adjusting the strength of said electrical audio signal from said amplifier means;

E) electric power means for connecting and providing electric power to said device;

F) a housing having broad front and back faces with the peripheries thereof joined together by a narrow perimetral edge to define an enclosure, said enclosure containing said FM radio receiver means, said infrared radiation receiver means, said audio amplifier means, said volume control means, and said electric power means;

G) a pair of elongate arms, each of said arms connected at a proximal end to said housing, said arms having long axes;

H) an earphone connected at the distal end of said each arm and operatively connected to said audio amplifier means for converting said electrical audio signal into audible sound at the ears of the user;

I) said arms having an operational configuration in which said earphones are positioned at a distance from said housing and opposed to, and spaced apart from, one another by a space less than the distance between the user's ears so that when said earphones are applied to the ears, spring bias generated by forcing said arms apart will hold said earphones and said device in said operational configuration and wherein the distance from said earphones to said housing being great enough so that said housing will rest comfortably and inconspicuously below the user's chin; and in which said perimetral edge is curvilinear, and said arms are unjointed and elastic, said arms having sufficient elasticity to bend around said perimetral edge to provide a compact configuration with said arms protectively adjacent said perimetral edge.

6. The device according to claim 5, in which said perimetral edge is provided with at least one indented recess to protectively receive said earphone in said compact configuration.

7. The device according to claim 6, further comprising attaching means connected to said perimetral edge for releasably holding said arms in said compact configuration.

* * * * *